United States Patent [19]

Jackson

[11] 4,023,612

[45] May 17, 1977

[54] CONTINUOUS CASTING MOLD AND PROCESS OF CASTING

[75] Inventor: Charles Richard Jackson, Dyer, Ind.

[73] Assignee: Inland Steel Company, Chicago, Ill.

[22] Filed: Nov. 25, 1975

[21] Appl. No.: 635,078

[52] U.S. Cl. ..... 164/82; 164/273 R
[51] Int. Cl.[2] ..... B22D 11/04
[58] Field of Search ..... 164/82, 273 R, 282, 164/283 M

[56] References Cited

UNITED STATES PATENTS

| | | | |
|---|---|---|---|
| 3,710,845 | 1/1973 | Burhardt et al. | 164/273 R |
| 3,773,099 | 11/1973 | Rossi | 164/282 X |
| 3,900,066 | 8/1975 | Schoffmann | 164/282 |
| 3,910,342 | 10/1975 | Johnson | 164/273 R |
| 3,978,909 | 9/1976 | Schoffmann | 164/273 R |

*Primary Examiner*—Ronald J. Shore

*Attorney, Agent, or Firm*—Hibben, Noyes & Bicknell, Ltd.

[57] ABSTRACT

A continuous casting process and slab plate mold for casting an endless solidified steel shell enclosing a liquid core which is formed of spaced parallel longitudinal wall plates having held therebetween spaced inwardly tapered transverse wall plates provided with specially contoured inner surfaces comprising flat sections extending inwardly from each longitudinal edge disposed perpendicular to the longitudinal wall plates and having a length about equal to the thickness of the wide walls of the casting shell at the lower end of the mold with the inner ends of said flat sections being connected by a convex section whose curvature is such that the convex section is maintained in supporting contact with said casting as the casting is moved downwardly through said mold; whereby the pressure of the casting shell on the transverse wall plates is evenly distributed so that uneven wear is avoided and the working life of the transverse wall plate substantially extended.

6 Claims, 6 Drawing Figures

CONTINUOUS CASTING MOLD AND PROCESS OF CASTING

The present invention relates generally to continuous casting of metals and more particularly to the continuous casting of steel slabs.

When continuously casting steel slabs with a conventional continuous casting 4-piece plate mold comprising a pair of spaced longitudinal or wide wall plates mounted parallel and generally disposed vertically within a support frame and having clamped between the longitudinal plates a pair of spaced transverse or narrow end wall plates having inner surfaces which taper inwardly toward the lower end of the mold, one problem encountered is the necessity of periodically reworking the mold plate so as to avoid discontinuities in the casting process and provide a uniform casting. The reworking of the narrow end plates of the mold due to continuous wear and thermal attrition is particularly burdensome (see U.S. Pat. No. 3,735,801). For example, it has heretofore been necessary to rework the narrow end wall plates of a slab mold of the foregoing type after casting about 3000 tons of steel at a rate of approximately 65 inches per minute, whereas about 12,000 tons of steel can be cast before the wide wall plates of the same plate mold require reworking. And, as the continuous casting line must be shut down and a new plate mold substituted whenever the mold end plates require reworking, it is important to increase to a maximum the working life of the mold end wall plates in order to maximize production and reduce continuous casting operation costs.

One means which has been proposed for reducing the frequency of reworking the mold plates is to employ wear resistant exchangeable corner pieces which are fitted into the ends of the narrow end wall plates and which engage the sides of the wide wall plates (see U.S. Pat. No. 3,662,814). It will be apparent, however, that the use of a plurality of corner pieces complicates the plate mold structure and makes it more expensive to construct and operate the plate mold, particularly when it is necessary to replace the end plates or change the dimension of the slab casting.

Accordingly, it is an object of the present invention to provide an improved continuous slab casting process and molding apparatus which is capable of producing continuous slab castings more economically.

It is another object of the present invention to provide an improved continuous slab casting mold which requires less frequent reworking of the mold.

It is still another object of the invention to provide an improved slab casting process and mold which improve the continuity of the casting and provide more uniform continuous castings.

Other objects of the present invention will be apparent from the following detailed description and claims when read in conjunction with the accompanying drawing wherein:

Figure 1:
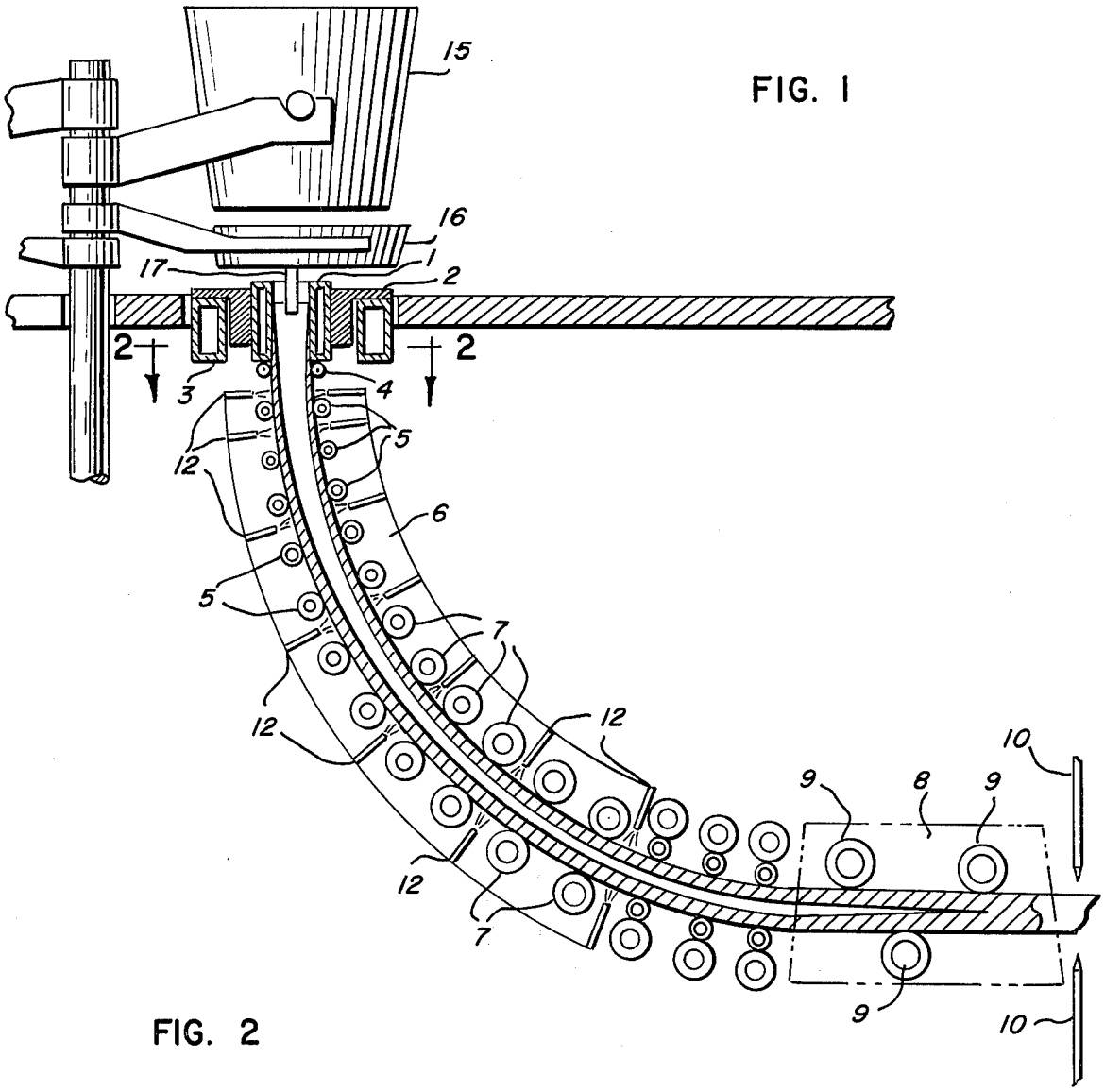
FIG. 1 is a fragmentary schematic side elevational view partially in vertical section of a continuous slab casting apparatus embodying the present invention.

Investigations have revealed that in a conventional continuous casting 4-piece plate mold for casting steel slabs, such as those having a width ranging from about 30 to 66 inches and a thickness between about 8.5 and 9.5 inches, and in which the end wall plates forming the narrow ends of the slab casting have inner surfaces which are tapered or slanted inwardly toward the lower end of the mold while the wide wall plates forming the broad side walls of the casting are substantially parallel and generally vertically disposed, the end wall plates are subjected to the most severe abrasion and damage along each of the outer longitudinally extending edge portions of the end wall plates and the amount of wear on the end wall plates decreases progressively as the distance inwardly from the wide side walls of the casting shell increases, with minimal wear occurring at a point midway between the lateral edges of the end plates. As a result, those portions of the end wall plates adjacent the lateral edges soon become worn and uneven and require frequent reworking of the end wall plates in order to maintain the integrity and continuity of the casting as the slab is withdrawn from and to provide a casting of acceptance quality, particularly when casting steel at the relatively high casting rates of about 65 inches per minute or above.

It has now been discovered that the necessity of reworking the slab-forming inner surfaces of the end walls of a mold having the usual parallel wide walls and inwardly tapered end walls, such as the conventional 4-piece plate mold, can be significantly reduced by using end walls provided with specially shaped inner surfaces which in traverse cross-section have flat sections disposed perpendicular to the wide walls extending inwardly from each of the longitudinal lateral edges of the end walls and have the inner ends of the flat sections connected by a section with a slightly convex curvature. The solidified shell with its liquid core formed in a plate mold having end wall plates specially contoured in the above manner is continuously withdrawn from the lower end of the plate mold between conventional flat support rolls engaging the opposite disposed wide faces of the casting without employing containment rolls for the narrow end walls, even when casting thick slabs at high casting rates, and solidification of the casting is completed by means of a conventional secondary cooling treatment. The continuous slab casting as withdrawn from the mold has flat wide lateral surfaces and very slightly concave narrow end surface which on completely solidifying shrink so that the narrow ends of the slab casting are substantially flat.

The flat sections provided on the end wall plates extending perpendicularly inwardly from each of the lateral long edges thereof should preferably have a length, at least at the lower end of the mold, about equal to the maximum thickness of the wide wall of the casting (i.e. the thickness at the point where the casting is withdrawn from the mold), since the unusual amount of abrasion which occurs adjacent the lateral edges of the end wall plates is primarily the result of the portions of the narrow end walls of the slab casting, which also comprise the ends of the wide walls of the solidification metal skin or shell of the casting, exerting a maximum abrasive force against the contiguous surfaces of the end wall plates.

It will be evident that the continuous columns of solidified metal which form the wide faces of the slab casting and which also comprise the ends of the narrow faces of the slab casting cannot be compressed appreciably when the casting is drawn downwardly within the mold between the surfaces of the inwardly slanted end plates to that there is maximum abrasive force exerted against the end wall plates in an area extending inwardly only a short distance from the opposite longitudinal edges thereof. As the transverse distance from the wide walls of the casting increases, however, the abrasive forces on the end wall plates decrease and are a minimum at the midpoint of the narrow end walls of the casting, because the intermediate portions of the end walls of the casting have only molten metal within the interior of the shell of the casting in supporting contact and these intermediate portions of the end walls are more readily yieldable as the distance away from the solid solumn of metal forming the wide faces of the casting increases.

The degree of curvature of the generally convex interconnecting section between the two flat sections of the end wall plates should be sufficient to maintain the convex section in supporting contact with the casting so as to distribute the outwardly ferrostatic pressure exerted by the molten metal within the casting shell evenly over the end wall plates and minimize the abrasive forces which are exerted by the end walls of the casting on the end wall plates. For example, in a slab casting in which the wide faces have a width of about 46 inches and the end walls of the casting are between about 8.25 and 9.25 inches long and the inner surfaces slant inwardly toward the bottom of the mold about 0.8% of the width of the mold, a suitable distance between the chord or plane of the flat sections and the midpoint of the interconnecting convex section on the end plates is about 0.175 inches. When the curvature of the convex section of the end wall plate is further increased appreciably so that there is excessive friction at the middle region of the end wall plates, the end walls of the casting tend to have transverse cracks formed therein which are spaced inwardly from the edges of the slab and are spaced every few inches along the length of the casting. If the curvature of the convex section of the end wall plate is not excessive, the transverse cracks will gradually become less frequent and will soon disappear after the initial break-in period of the casting operation is completed.

Figure 2:
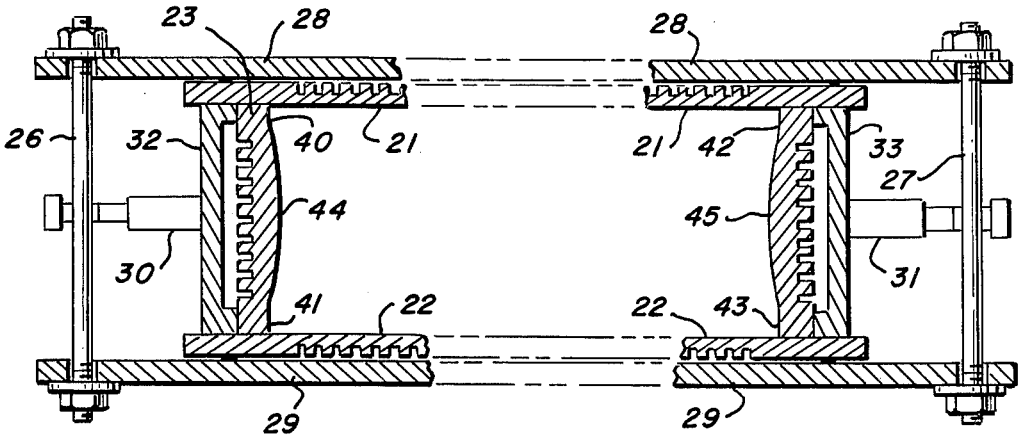
FIG. 2 is a schematic horizontal sectional view taken along the line 2—2 of FIG. 1.
Figure 3:
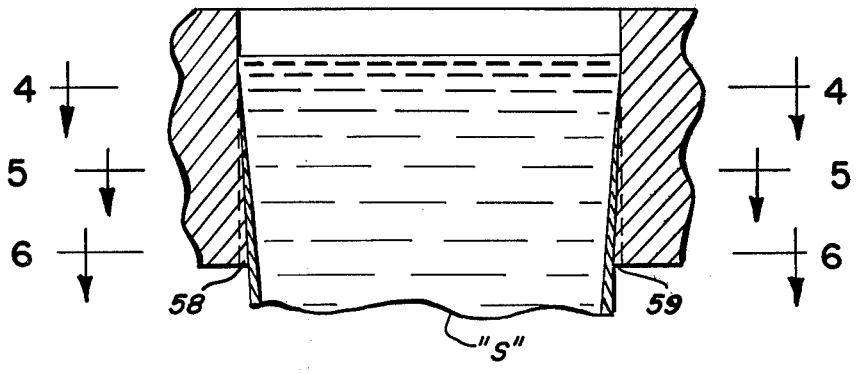
FIG. 3 is a fragmentary schematic vertical sectional view of a modified form of a plate mold structure which can be used in the present invention.
Figure 4:
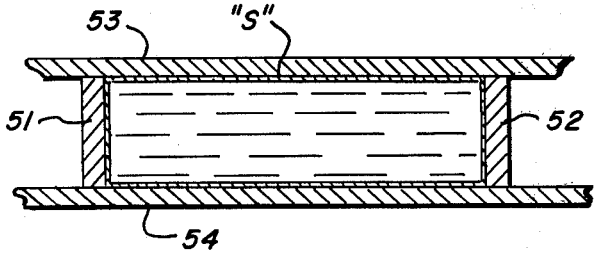
FIG. 4 is a horizontal sectional view taken along the line 4—4 of FIG. 3.
Figure 5:
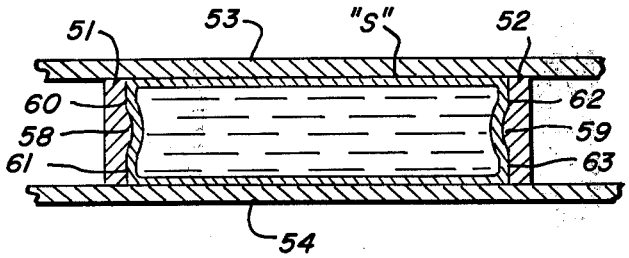
FIG. 5 is a horizontal sectional view taken along the line 5—5 of FIG. 3.
Figure 6:
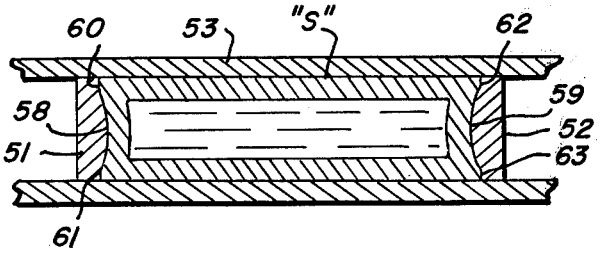
FIG. 6 is a horizontal sectional view taken along the line 6—6 of FIG. 3.

The present invention will be more clearly understood by referring to FIGS. 1 and 2 of the drawing illustrating one embodiment of the present invention wherein a water cooled 4-piece plate mold 1 is mounted in a support frame 2 connected with an oscillating means 3 for reciprocably moving the mold 1 and frame 2 in a vertical direction. Two pairs of foot rolls 4 are preferably provided and oscillate with the mold 1. Vertical containment and guide rolls 5 comprising a bearing stand 6 are arranged below the mold 1. At the lower end of the bearing stand 6 bending zone 7 and straightening zone 8 are provided from which the strand is led in a horizonal direction over straightening rolls 9. Lance means 10 are provided for cutting the strand into slabs of suitable length. The secondary cooling zone extends from below the mold 1 to about the straightening rolls 9 and comprise cooling water supply ducts and spray jets 12 which direct cooling water onto the upper and lower longitudinal surfaces of the strand "S". If desired, small cooling water sprays can be directed against the narrow ends of the casting as the strand is withdrawn from the mold 1 and can be mounted on the lower end of the mold 1 adjacent one pair of the foot rolls 4. Supply means are provided above the mold 1 for continuously supplying molten metal to the mold 1 comprising a ladle 15 mounted above a tundish 16 having a pouring nozzle 17 which extends into the mold 1 below the level of molten metal therein.

The mold 1 of the present invention comprises a 4-piece copper plate mold (see FIG. 2) having two spaced longitudinal planar wide wall plates 21, 22 which form the broad lateral side walls of a slab casting and two spaced transverse or end wall plates 23, 24 which form the narrow end walls of the slab casting. The longitudinal wall plates 21, 22 are mounted within the supporting frame 2 in parallel relationship and the transverse or end wall plates 23, 24 are disposed between the wide wall plates 21, 22 with the inner surfaces thereof having a gradual inwardly taper toward the lower end of the mold 1 (preferably about 0.8% of the length of the mold wide face). The ends of the transverse wall plates 23, 24 are held in fluid-tight engagement with inner surfaces of the longitudinal wall plates 21, 22 by means of clamps 26, 27 and backing plates 28, 29 of the support frame 2. The support bars 30, 31 and backing plates 32, 33 engage the outer surface of the transverse wall plates 23, 24, respectively. Each of the mold plates 21–24 has cooling water passages formed therein over substantially the entire outer surface to effect rapid heat withdrawal from the mold plates. The transverse wall plates 23, 24 which form the narrow end wall of the slab casting have specially contoured inner surfaces comprised of flat sections 40, 41 and 42, extending inwardly from the outer lateral edges thereof disposed perpendicular to the inner surface of the longitudinal wall plates 21, 22, respectively, and are provided with an inwardly extending slightly convex section 44, 45, respectively, connecting the opposite inner ends of the flat sections 40, 41 and 42, 43.

In the four-piece plate mold illustrated in FIG. 2 for the continuous casting of steel slabs having dimensions of 48 × 8.25 inches the inner surfaces of the transverse wall plates 23, 24 which have an inward taper of about 3.8 inches (i.e. 0.8% of the width of the mold) have flat sections 42, 43, preferably about 0.75 inches long, extending perpendicularly inwardly from the lateral edges with an interconnecting uniform convex section 43, 44, respectively, which at midpoint extends about 0.175 inch above the plane of the flat sections and are symmetrically disposed between the lateral edges of the plates 23, 24, respectively. With a plate mold having the foregoing configuration it is possible to cast between 12,000 and 15,000 tons of aluminum killed steel at a casting rate of about 65 inches per minute in a continuous casting process of the type disclosed in the Mills et al U.S. Pat. No. 3,517,726 before it becomes necessary to rework the transverse wall plates. Thus, with a plate mold having the herein disclosed improved transverse wall plate structure, it is possible to cast the same amount of steel as with the longitudinal wall plates before reworking becomes necessary. Plate molds having the improved transverse wall plate structure of the present invention also result in fewer breakouts occurring during secondary cooling, because of the substantial reduction in the amount of wear on the mold plates, particularly in the critical corner areas. Also, the slab castings produced have substantially uniform dimensions without bulges in the narrow end walls which are often encountered when continuously casting wide slabs at high casting rates. The latter improvement is due to the slightly concave surfaces formed within the mold between the lateral edges of the end walls of the casting which are more resistant to the pressure of the molten metal core during the secondary cooling of the slab casting.

In the modified form of the invention shown in FIGS. 3–6, the four-piece copper plate mold 50 is formed in the same manner described in connection with the plate mold 1 with spaced transverse wall plates 51, 52 being clamped between the spaced longitudinal wall plates 53, 54. The transverse wall plates 51, 52 taper inwardly toward the lower end of the mold and the longitudinal wall plates 53, 54 are parallel and substantially vertical disposed, as in mold 1.

The transverse wall plates 51, 52 differ from the transverse plates 23, 24 of FIG. 2, however, in that adjacent the upper ends of the transverse wall plates 51, 52 each of the plates 51, 52 has a planar surface portion 56, 57, respectively, extending the entire width of the transverse wall plates 51, 52 with no convex section. Below the planar surface portion and continuing to the lower end of the mold 50, the end plates 51, 52 are provided with a symmetrically disposed, convex sections 58, 59, respectively, of progressively increasing height and length and with flat sections 60, 61 and 62, 63 which extend perpendicularly inwardly from the lateral edges, respectively, and which gradually decrease in length until at the lower end of the mold 50 the cross-section of each of the wall plates 51, 52 is substantially the same as the cross-section of the wall plates 23, 24 in FIG. 2. The horizontal sectional views in FIGS. 4, 5 and 6 of the drawing shows the progressive increase in the length and height of the convex sections 58, 59 and the gradual decrease in the length of the flat sections 60, 61 and 62, 63, as the lower end of each of the transverse wall plates 51, 52 is approached.

The partially solidified slab casting is withdrawn from the lower end of the mold 50 in the same manner as the slab in the mold 1, has the same cross-sectional configuration as the slab shown in FIG. 2, and exhibits the same advantages and improvements as the casting formed in the mold 1 of FIG. 2. In addition, the transverse plates 51, 52 are subjected to less stress and require less reworking than the end plate 23, 24 of FIG. 2 in order to maintain the end plates in satisfactory working condition. It will be apparent that the pressure exerted on the plates 51, 52 by the casting will increase gradually and will be greatest only at the lower end of the mold as the casting is drawn downwardly within the mold, because of the gradual increase in the inwardly taper of the transverse wall plates and the increase in thickness of the shell of the casting at the lower end of the mold.

It will be understood that in the present invention the slab mold can be of any type and is not restricted to the dimensions of the herein disclosed molds used to illustrate the invention. Also, the transverse mold walls can have other degrees of taper than that specifically disclosed herein without departing from the present invention. It should be apparent, moreover, that when the dimensions of the mold and the taper of the transverse walls of the mold are made larger or smaller, it may be necessary to change the length of the flat sections and the dimensions of the convex section in accordance with the criteria disclosed herein.

I claim:

1. In a mold for continuously casting steel slabs employing spaced substantially parallel longitudinal walls and spaced transverse walls having oppositely disposed inwardly tapered inner surfaces, the improvement which comprises; transverse walls having flat sections which extend inwardly from the opposite longitudinal edges thereof disposed perpendicular to said longitudinal walls and having the inner ends of said flat sections connected by a convex section, and said transverse wall having an inner surface characterized by resistance to wear along said flat sections; whereby the frequency with which the said transverse walls require reworking in order to maintain said walls in satisfactory working condition is substantially reduced.

2. In a continuous casting plate mold for producing a steel slab having a solidified steel shell enclosing a liquid core and employing spaced oppositely disposed substantially parallel longitudinal wall plates forming wide walls of a continuous slab casting and coacting spaced transverse wall plates forming narrow end wall having oppositely disposed inwardly tapered inner surfaces, the improvement comprising; transverse wall plates each having formed on the inner surface at least adjacent the lower ends thereof flat sections disposed perpendicular to said longitudinal wall plates extending inwardly from the lateral longitudinal edges a distance about equal to the thickness of the shell of the wide walls of the casting when the casting is withdrawn from the mold with the inner ends of said flat sections being interconnected by a convex section extending above the plane of said flat sections with said inner surfaces adapted to remain in supporting contact with the end surface of a said casting being formed within said mold, and said transverse wall plates characterized by being resistant to wear such that the frequency with which said transverse wall plates require reworking in order to maintain said mold in satisfactory working condition is substantially reduced.

3. A plate mold as in claim 2, wherein the dimensions of said flat sections and said interconnecting convex section remain constant at every transverse section taken through said mold.

4. A plate mold as in claim 2, wherein the length of each said flat sections gradually decreases and the dimensions of said convex section gradually increase at each progressively lower transverse section taken through said mold.

5. A plate mold as in claim 2, wherein each said transverse wall plate has an upper portion of said inner surface provided with a planar surface extending the width of said transverse wall plate and said convex section connecting the ends of said flat sections is formed below said planar surface and extends longitudinally to the lower end of said mold with the transverse length and height of said convex section gradually increasing to a maximum at about the lower end of said mold.

6. A continuous process for casting a steel slab in the form of an endless strand which reduces the frequency the transverse narrow end walls of a continuous casting mold need reworking in order to maintain the slab mold in satisfactory working condition comprising;

continuously introducing molten metal into a water cooled open ended vertically disposed generally rectangular mold which forms a solidified steel shell enclosing a liquid core with said mold having spaced parallel longitudinal walls forming flat side walls of said casting and coacting spaced transverse walls having oppositely disposed inwardly tapered inner surfaces forming narrow end walls of said casting, said transverse walls having flat sections extending inwardly from each of the longitudinal edges thereof perpendicular to said longitudinal walls having a length at least at the lower end of said mold about equal to the thickness of the shell forming the side walls of the casting at the point the casting is withdrawn from the mold with a convex section connecting the inner ends of said flat sections, and withdrawing said casting from said mold between spaced oppositely disposed planar containment rolls which engage the side walls of said casting below the lower end of said mold.

* * * * *

UNITED STATES PATENT AND TRADEMARK OFFICE

CERTIFICATE OF CORRECTION

PATENT NO. : 4,023,612

DATED : May 17, 1977

INVENTOR(S) : Charles Richard Jackson

It is certified that error appears in the above-identified patent and that said Letters Patent are hereby corrected as shown below:

Col. 2, line 17, "subjected" should read --subject--.
line 28, the words "the mold" were left out after the word "from".
line 38, "traverse" should read --transverse--.
line 47, "opposite" should read --oppositely--.
line 55, "surface" should read --surfaces--.
line 68, "solidification" should read --solidified--.

Col. 3, line 10, "to that" should read --so that--.
line 19, "contact and these" should read --contact therewith and these--.

Col. 4, line 38, "40, 41 and 42 extending" should read --40, 41 and 42, 43 extending--.

Col. 5, line 21, "substantially vertical" should read --substantially vertically--.

Col. 5, line 51, "are subjected to" should read --are subject to--.

Col. 6, line 66, "continuous casting mold" should read --continuous casting slab mold--.
line 67, "maintain the slab mold" should read --maintain the mold--.

Signed and Sealed this

Seventh Day of February 1978

[SEAL]

Attest:

RUTH C. MASON
Attesting Officer

LUTRELLE F. PARKER
Acting Commissioner of Patents and Trademark